United States Patent [19]

Mamantov

[11] Patent Number: 4,802,970

[45] Date of Patent: Feb. 7, 1989

[54] PROCESS FOR PREPARING FLUORINE BY ELECTROLYSIS OF CALCIUM FLUORIDE

[75] Inventor: Gleb Mamantov, Knoxville, Tenn.

[73] Assignee: E. I. Du Pont de Nemours and Company, Wilmington, Del.

[21] Appl. No.: 200,093

[22] Filed: May 31, 1988

[51] Int. Cl.[4] ..... C25B 1/00

[52] U.S. Cl. ..... 204/60

[58] Field of Search ..... 204/60

[56] References Cited

U.S. PATENT DOCUMENTS 3,196,091 7/1965 Mastrangelo ..... 204/60

3,324,016 6/1967 Langer ..... 204/60

*Primary Examiner*—G. R. Andrews

*Attorney, Agent, or Firm*—Charles E. Krukiel

[57] ABSTRACT

A process for producing fluorine from calcium fluoride in which calcium fluoride is dissolved in a molten salt electrolyte containing an alkali metal tetrafluoroborate and the melt is electrolyzed at a temperature below 400° C.

6 Claims, 1 Drawing Sheet

PROCESS FOR PREPARING FLUORINE BY ELECTROLYSIS OF CALCIUM FLUORIDE

BACKGROUND OF THE INVENTION

The present invention relates to an improved process for preparing fluorine by electrolysis of calcium fluoride ($CaF_2$), and, more particularly, to a process in which fluorine is produced by dissolving $CaF_2$ in a molten salt which contains an alkali metal tetrafluoroborate and electrolyzing the melt at a temperature below 400° C.

Fluorine is the most reactive of all known chemical elements, and it is prepared commercially by the electrolysis of hydrogen fluoride (HF). HF is prepared by reacting $CaF_2$, a naturally occurring mineral known as fluorspar, with sulfuric acid. During the electrolysis, $F_2$ is produced at the anode, and $H_2$, which is vented and burned, is produced at the cathode. It would be desirable, therefore, to be able to produce fluorine directly from $CaF_2$ and thereby eliminate the intermediate production of HF and the venting and burning of $H_2$.

U.S. Pat. No. 3,684,667 describes a method for producing fluorine and volatile fluorine compounds by the electrolysis of an electrolyte consisting of molten fluorides, e.g., calcium fluoride, using a plasma as the anode. The energy required to maintain a plasma is relatively high and can be expensive.

U.S. Pat. Nos. 3,196,090 and 3,196,091 describe the electrolysis of sodium tetrafluoroborate ($NaBF_4$) at about 440° to 480° C. between a lead cathode and a graphite or gold anode. A fluorine/$BF_3$ mixture is produced at the anode, and a lead/sodium alloy is produced at the cathode. The $NaBF_4$ starting material, however, is derived from HF as an intermediate.

Other attempts to produce fluorine directly from the electrolysis of $CaF_2$ have been unsuccessful and have resulted instead in the production of fluorocarbons. For example, British patent No. 863,635 describes the electrolysis of $CaF_2$ at 1450° C. using a carbon anode to produce $CF_4$; British patent No. 863,602 describes the electrolysis of a mixture consisting of NaF, $CaF_2$, and $MgF_2$ to produce $C_1$ to $C_3$ fluorocarbons; and U.S. Pat. No. 2,835,711 describes the electrolysis of carbon with $CaF_2$ and group IIA metal chlorides at temperatures of from 2000° to 5000° C. to produce fluorocarbons and chlorofluorocarbons.

SUMMARY OF THE INVENTION

According to the present invention, a process has been developed for producing fluorine directly from $CaF_2$ having the following steps:

(a) dissolving $CaF_2$ in a molten salt electrolyte containing an alkali metal tetrafluoroborate; and (b) electrolyzing the electrolyte at a temperature below 400° C. between an anode selected from a carbon material and nickel and a cathode selected from lead, tin, zinc and tin/zinc alloy.

A mixture of elemental fluorine and $BF_3$ is produced at the anode and calcium is deposited at the cathode along with the alkali metal of the tetrafluoroborate selected for the electrolyte. Optionally, the alkali metal tetrafluoroborate electrolyte may also contain one or more alkali metal fluorides or mixtures thereof. The alkali metals which are useful in the process of this invention are selected from Na, K and Li.

DETAILED DESCRIPTION OF THE INVENTION

Figure 1:
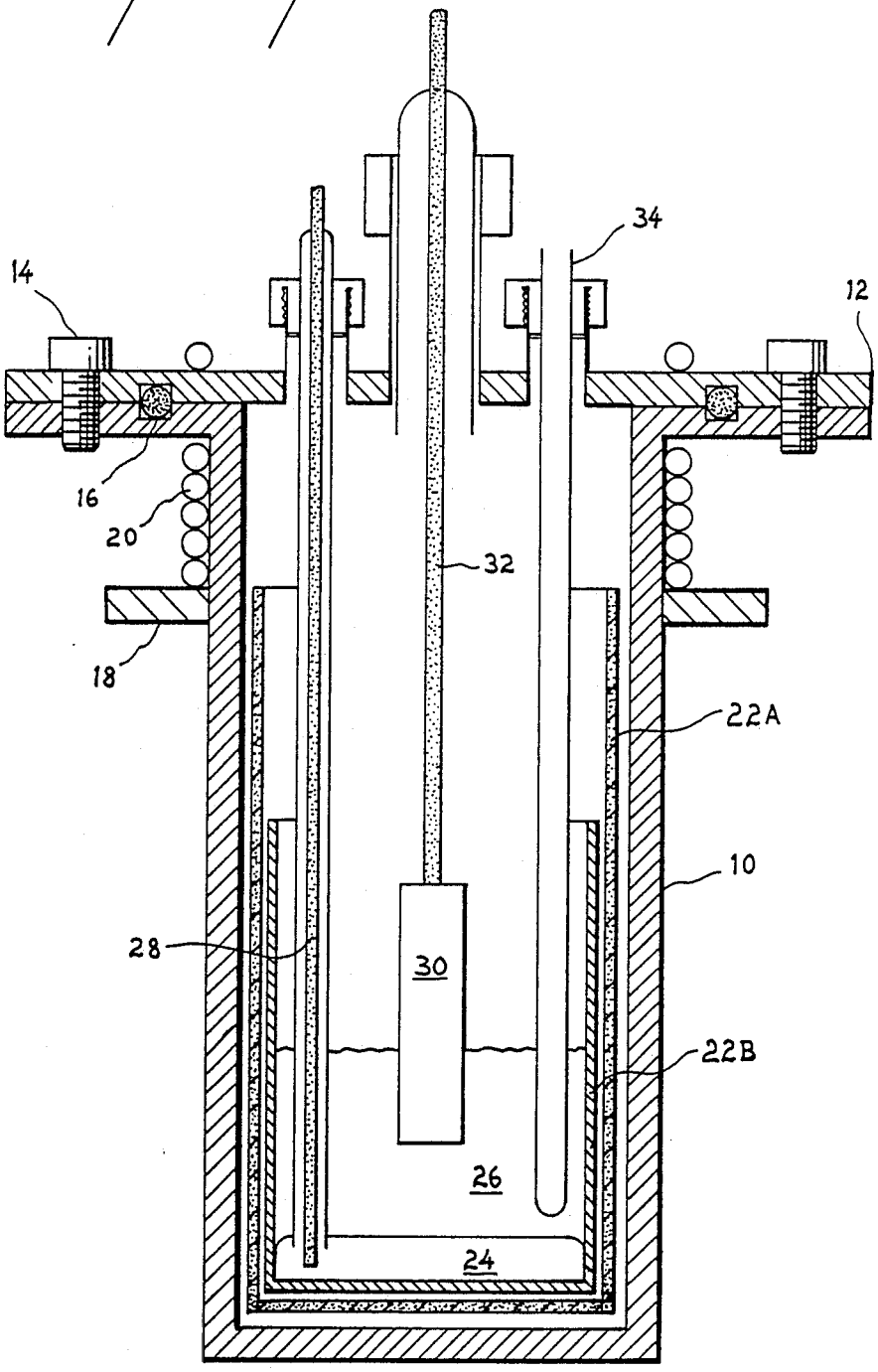
FIG. 1 is a cross sectional view of a typical electrolytic cell which can be used in practicing the process of this invention.

The present invention is an improved process for producing fluorine directly from $CaF_2$ by electrolysis.

Referring now to FIG. 1 there is shown for purposes of illustration a cross-sectional view of an electrolytic cell of the type useful in practicing the process of this invention. The cell has a cylindrical flanged body 10 and a lid 12 typically fabricated from nickel. The lid is attached to the flanged body with bolts 14, and an o-ring, such as a "Viton" o-ring, 16 is placed between the mating flange surfaces as shown to seal the cell. A support ring 18 is provided, above which are located a series of cooling coils 20 for controlling the temperature of the upper portion of the cell. Two nested crucibles 22A and 22B made of alumina are located within the cell, the outer crucible 22A being a precautionary measure should the inner crucible 22B break or develop a leak during operation.

The cathode material, which forms a pool 24 beneath the molten electrolyte 26 during operation, is selected from analytical grades of Pb, Sn, Zn, and Sn/Zn alloy. The material to be used is washed successively with 1 M HCl, $H_2O$, and ethanol, then dried and molten in a ceramic crucible in an inert atmosphere, such as argon. The cathode material is then cooled and cut into pieces of appropriate size to be added to the cell. Sn/Zn alloys (e.g. 80/20 mol %) can be made by melting the corresponding amounts of Sn and Zn together in a ceramic crucible, cooling, and then cutting the alloy into the desired shape and size for introduction into the cell. Electrical contact with the cathode metal pool 24 can be made as shown using an alumina-sheathed ⅛ inch diameter (0.32 cm) nickel contact rod 28.

The anode 30 can be fabricated from different carbon materials, such as, for example, glassy carbon and pyrolytic graphite which are commercially available, or it can be fabricated from nickel. The preferred anode material is pyrolytic graphite for its availability, resistance to fluorine attack during cell operation, and price relative to other materials. In one example of this invention the anode material is pyrolytic graphite which has been machined into pieces 5 cm×1.5 cm×0.6 cm and is then degassed at 500° C. to remove impurities, especially water. Any convenient means can be used to secure the anode material to the anode contact lead 32. The contact lead, made of nickel, is insulated from the cell by an alumina sleeve.

The electrolytes comprise alkali metal tetrafluoroborates and may optionally include alkali metal fluorides, or mixtures thereof, in which the alkali metal is selected from K, Na and Li. Anhydrous KF (Aldrich, 99%), NaF (Aldrich, 99%), LiF (Alfa Products, 99%), $NaBF_4$ (Alfa Products, 99%), and $LiBF_4$ (Aldrich, 98%) were selected to demonstrate the process and are the preferred electrolyte components. Three tetrafluoroborate-containing electrolyte mixtures were prepared having the following compositions: $LiBF_4$/LiF, 90/10 mol %; $LiBF_4$/$NaBF_4$, 50/50 mol %; and $NaBF_4$/KF, 90/10 mol %. These mixtures were selected for their low melting points which, in turn, will reduce attack of the anode and cell by fluorine generated during operation. Other mixtures can also work satisfactorily.

The electrolyte components were prepurified by heating under vacuum at 200° C. for three days to remove as much water and HF as possible before being introduced into the cell. $CaF_2$ (Cerac, 99.99% anhydrous) was used without further purification.

In carrying out the process of this invention, typically 150 grams of electrolyte and 15 grams of $CaF_2$ are charged to the cell in a glove box. The cell is placed within an electric furnace (e.g., Lindberg Model 56622) having a temperature controller (e.g., Lindberg Model 59344) and heated to about 20° C. above the melting point of the electrolyte. During heating about 1 to 2 mol % of the $CaF_2$ dissolves in the electrolyte, and the remainder forms a layer on the bottom of the crucible. A gas stream comprising 5% by wt fluorine and 95% by wt helium is then bubbled through the melt to remove remaining impurities and to passivate the cell against fluorine to be generated later. Normally the gas stream is bubbled for about 8 hours to insure removal of impurities. The off-gas during passivation can be passed through an activated alumina column to remove fluorine prior to venting.

After passivation, the cell is purged with an inert gas, e.g., argon, to remove residual fluorine. A period of four hours was found to be satisfactory, the absence of fluorine being determined using a KI solution. After purging, the cathode metal pieces are added to the cell under a fast argon flow. Temperature can be monitored by providing a well 34 suitable for placing a thermocouple therein. Once the cathode is molten, the anode and cathode leads can be introduced. In operation, the molten cathode metal pool partially covers the undissolved $CaF_2$. The anode and cathode leads are then connected to a potentiostat-galvanostat (e.g., Princeton Applied Research Model No. 173) which is equipped with a function generator (e.g., Princeton Applied Research Model 175). Cell voltage can be recorded on a multimeter (e.g., Keithley Model 616), and transients can be recorded on a digital storage oscilloscope (e.g., Nicolet Model No. 2090).

Located downstream from the cell is a trap for $BF_3$ (or $CaF_2$ or LiF) followed by a KI solution in which $I_2$ is formed by reaction with fluorine generated during electrolysis. The trap and KI solution were also purged with an inert gas prior to operation to remove impurities, and the KI solution was protected from air oxidation by a bubbler filled with silicone oil.

In the electrolysis of $CaF_2$ solutions in molten salts the evolution of fluorine on the anode is accompanied by deposition of a metal from the electrolyte at the cathode. The potentials at which the cations K, Ca, Na, and Li may be discharged are very close, but deposition can be influenced by operating variables. Consequently, determination of decomposition potentials at these cations at operating conditions is of practical importance for the selection of an optimum operating current density range. Cell voltages (E) were measured as a function of applied constant current (I) at increasing anode current densities between 0 and 100 mA/cm$^2$. Plots of E vs. I produced plateaus where E remains constant although I is being increased. Such plateaus, when extrapolated to a zero current density, indicate the voltage at which the cation is being reduced. The plateau region, therefore, is a preferred operating region for the electrolysis.

Voltage vs. current measurements were made for three tetrafluoroborate containing electrolytes: For $LiBF_4$/ LiF (90/10 mol %) at 315° C., for $LiBF_4$-/$NaBF_4$ (50/50 mol %) at 340° C., and for $NaBF_4$/KF (90/10 mol %) at 375° C. first plateau in the E vs. I plot occurred at 1.45 volts for all three eutectics (when extrapolated to I=0). This indicated the decomposition of an impurity common to all three eutectics, e.g., water.

The $LiBF_4$/LiF eutectic showed a plateau between 45 and 80 mA/cm$^2$ at 3.9 volts; the same eutectic with $CaF_2$ dissolved in it exhibited an additional plateau between 35 and 40 mA/cm$^2$ at 3.45 volts. Hence, the reduction of $Li_+$ would be expected at 3.9 V and the reduction of $Ca^{2+}$ would be expected at 3.45 V. To minimize reduction of $Li^+$ a current density of 45 mA/cm$^2$ was used.

The LiBF4/$NaBF_4$ melt with and without $CaF_2$ dissolved in it exhibited plateaus between 35 to 100 mA/cm$^2$ which, when extrapolated to I=0, intersected at 3.45 V and 3.9 V. This indicated that the reduction of $Na^+$ occurs at the same potential, namely 3.45 V, as does the reduction of $Ca^{2+}$ at current densities of 35 to 40 mA/cm$^2$.

For $NaBF_4$/KF with $CaF_2$ dissolved in it, the first significant plateau occurred at 3.0 volts between 0 to 40 mA/cm$^2$. This corresponds to $K^+$ reduction. A second plateau occurred at 3.45 volts between 40 to 70 mA/cm$^2$, and this corresponds to codeposition of Na and Ca.

Thus, codeposition of Ca and alkali metals is unavoidable when electrolyzing $CaF_2$ in the presence of a large excess of tetrafluoroborate salts of alkali metals whose decomposition potentials are close to that of $Ca^{2+}$. Li based electrolytes offer an electrochemical advantage for a cleaner Ca deposit since the difference in decomposition potentials between $Ca^{2+}$ and $Li^+$ is greater than the difference between $Ca^{2+}$ and the other alkali metal based electrolytes. Li salts, however, are known to be more expensive than the Na or K analogs.

In practicing the process of this invention it is possible to minimize the concentration of codepositing alkali metals by selecting as the cathode a Sn/Zn alloy. Zn exhibits preferential solubility for Ca over the alkali metals and the Sn/Zn alloy has an operating temperature below 400° C. It is contemplated that any zinc alloy which is selective for Ca may be used as the cathode material as well as other metals which alloy with Ca but not with any or all other alkali metals.

The electrochemical processes involved in practicing the present invention involve at the cathode:

$$Ca^{++}+2e^- \rightarrow Ca$$

and $$M^+ + e^- \rightarrow M$$

where M=Li, Na, or K.

At the anode fluorine can evolve according to:

$$2F^- \rightarrow F_2 + 2e^-$$

as well as according to:

$$2\ BF_4^- \rightarrow 2BF_3 + F_2 + 2e^-$$

A large excess of BF4$^-$ present during electrolysis at the anode should make the latter a predominant path.

Consequently, the overall reactions which occur are as follows:

$$CaF_2+2MBF_4 \rightarrow Ca(BF_4)_2+2MF$$

$$Ca(BF_4)_2 \rightarrow 2Ca+F_2+2\ BF_3$$

The practice of the present invention provides further for the removal of $BF_3$ from the anode off-gas by absorption on $CaF_2$ or any of the alkali metal fluorides according to the following equation:

$$CaF_2+2BF_3 \rightarrow Ca(BF_4)_2$$

or $$MF+BF_3 \rightarrow MBF_4$$

which yields an anode gas free of $BF_3$ and allows for recycling of the $BF_4^-$ salt thus produced.

The present invention is illustrated in more detail in the following examples wherein anode current efficiency (ACE) is the ratio, in percent, of the quantity of fluorine actually produced to the quantity of fluorine which could be produced theoretically by the number of coulombs passed, and cathode current efficiency (CCE) is the ratio of metals actually produced to the theoretically possible amount of metals which could have been produced. ACE was determined by measuring the amount of iodine formed in a KI solution by reaction of fluorine generated during electrolysis. CCE was determined by dissolving the cathode in acid and determining Na, K, Li, and Ca by atomic absorption spectroscopy.

Positive identification of $BF_3$ was made by IR spectroscopy using the intense $BF_3$ bands at 1504, 1452, 721, 693, and 480 $cm^{-1}$. In all of the examples there was no IR evidence that significant amounts of fluorocarbons were formed during electrolysis.

EXAMPLE 1

This Example shows that electrolysis of $CaF_2$ dissolved in a $NaBF_4$/KF eutectic at 375° C. produces fluorine at the anode and that the preferred anode material is pyrolytic graphite.

A solution of 1 mol % of $CaF_2$ in 90 mol % $NaBF_4$ and 10 mol % KF was electrolyzed between a pool of molten lead (200 grams) as the cathode and anodes consisting of nickel, graphite, pyrolytic graphite and glassy carbon. During the electrolysis the anode gases were flushed from the cell with a stream of argon into a 3 M KI solution. Upon initiation of the electrolysis, the KI solution became yellow and then brownish-red after passage of 8000 coulombs. In the case of the graphite electrode analysis of the KI solution for $I_2$ showed that the anode current efficency (ACE) had been 23.1%.

Visual inspection showed severe corrosion of the Ni anode. Of the carbon anodes tested, pyrolytic graphite and glassy carbon showed less attack than graphite. Pyrolytic graphite was used as the anode material for subsequent experiments for economy.

EXAMPLE 2

This Example shows that flourine is evolved at the anode at current densities of 20 to 200 mA/$cm^2$ at cell voltages of 2.8 to 16.3 volts and that $BF_3$ is evolved along with $F_2$ at the anode.

The procedure in Example 1 was repeated at different current densities; the anode was pyrolytic graphite, the cathode was lead. Current densities (CD) and the corresponding anode current efficiencies (ACE) and cell voltages (CV) are listed in Table I.

TABLE I

| CD [mA/$cm^2$] | ACE [%] | CV [volts] |
|---|---|---|
| 200 | 12.2 | 16.3 |
| 80 | 23.1 | 8.6 |
| 40 | 29.5 | 5.0 |
| 20 | 16.4 | 2.8 |

The highest ACE was achieved at a CD of 40 mA/$cm^2$.

In addition to $F_2$, a white fog appeared in the trap above the KI solution, and a white solid precipitated at the bottom of the trap. This precipitate contained boron and fluorine in a molar ratio of 1:3 and was the hydrolysis product of $BF_3$. The presence of $BF_3$ in the anode off-gas was established independently by IR spectroscopy: the dominant bands in the sample spectrum at 1504, 1452, 721, 693 and 480 $cm^{-1}$ were those of $BF_3$.

EXAMPLE 3

This Example shows a $LiBF_4$/LiF eutectic as the solvent for $CaF_2$.

150 grams of a $LiBF_4$LiF eutectic (90/10 mol % ) was saturated with $CaF_2$. The anode was pyrolytic graphite, the cathode was Sn/Zn (80/20 mol % ), the ACD was 40 mA/$cm^2$, the temperature was 315° C., the cell voltage was 5.8 volts. The ACE was 70.1%, the CCE was 67.7%. The cathode product consisted of Ca and Li in the ratio of 1:1.8.

EXAMPLE 4

This Example shows that $LiBF_4$/$NaBF_4$ is a suitable solvent for $CaF_2$. Example 3 was repeated except that a saturated solution of $CaF_2$ in $LiBF_4$/ $NaBF_4$ (50/50 mol %) was electrolyzed with the results summaried in Table II.

TABLE II

| ACD [mA/$cm^2$] | CV [volts] | ACE % | CCE % | Ratios Na | Ca | Li |
|---|---|---|---|---|---|---|
| 50 | 6.7 | 57.9 | 57.3 | 1 | 4.4 | 30.4 |
| 40 | 5.7 | 53.4 | 52.9 | 1 | 4.6 | 7.3 |
| 30 | 3.6 | 12.6 | 12.4 | 1 | 4.2 | 1.0 |

EXAMPLE 5

This Example shows that $BF_3$ which is evolved during the electrolysis can be trapped by $CaF_2$ and/or LiF (as well the other alkali metal fluorides) due to formation of the tetrafluoroborates; the latter can thus be recycled.

Molten $CaF_2$-saturated $LiBF_4$/$NaBF_4$ equimolar mixtures (150 grams each) were electrolyzed at 340° C. between pyrolytic graphite anodes and Sn/Zn (80/20 mol %) cathodes. Traps containing 0.25 moles of either $CaF_2$ or LiF (heated to 250° C.) were placed into the anode off-gas streams before the gases entered the KI trap. In the Example in which $CaF_2$ was the $BF_3$ absorbent, no $BF_3$ passed through the melt; only then the white fog, which indicated the presence of hydrolysis products of $BF_3$, appeared above the KI solution. This corresponded to a 33% conversion of $CaF_2$ to $Ca(BF_4)_2$. In the case of the LiF trap, breakthrough of $BF_3$ occurred after passage of 32,000 coulombs which corresponded to a 70% conversion of LiF to $LiBF_4$.

I claim:

1. A process for producing fluorine from calcium fluoride comprising:

(a) dissolving calcium fluoride in a molten salt electrolyte containing an alkali tetrafluoroborate; and (b) electrolyzing the electrolyte at a temperature below 400° C. between an anode selected from a carbon material and nickel and a cathode selected from lead, tin, zinc, and tin/zinc alloy.

2. The process of claim 1 wherein the anode is a carbon material selected from pyrolytic carbon and glassy carbon and the cathode is a tin/zinc alloy containing 80 mol % tin.

3. The process of claim 1 or claim 2 wherein the electrolyte contains one or more alkali metal fluorides or mixtures thereof wherein the alkali metals are selected from sodium, potassium, and lithium.

4. The process of claim 3 wherein the electrolyte has the composition $LiBF_4$/LiF, 90/10 mol %.

5. The process of claim 3 wherein the electrolyte has the composition $LiBF_4$/$NaBF_4$, 50/50 mol % .

6. The process of claim 3 wherein the electrolyte has the composition $NaBF_4$/KF, 90/10 mol % .

* * * * *